US009999960B2

(12) United States Patent
Roberge, Jr. et al.

(10) Patent No.: US 9,999,960 B2
(45) Date of Patent: Jun. 19, 2018

(54) COOLANT DELIVERY SYSTEM FOR GRINDING APPLICATIONS

(71) Applicants: SAINT-GOBAIN ABRASIVES, INC., Worcester, MA (US); SAINT-GOBAIN ABRASIFS, Conflans-Sainte-Honorine (FR)

(72) Inventors: Bruce A. Roberge, Jr., Rutland, MA (US); John S. Hagan, Shrewsbury, MA (US); David C. Graham, Oakham, MA (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 0 days. days.

(21) Appl. No.: 14/579,743

(22) Filed: Dec. 22, 2014

(65) Prior Publication Data

US 2015/0202737 A1 Jul. 23, 2015

Related U.S. Application Data

(60) Provisional application No. 61/922,314, filed on Dec. 31, 2013.

(51) Int. Cl.
*B24B 55/02* (2006.01)
*B24B 19/00* (2006.01)

(52) U.S. Cl.
CPC ..... *B24B 55/02* (2013.01); *B24B 19/009* (2013.01)

(58) Field of Classification Search
CPC ..... B24B 55/02; B24B 19/009; B24B 19/002; B24B 19/04; B24B 3/021; B24B 9/00
See application file for complete search history.

(56) References Cited

U.S. PATENT DOCUMENTS 3,984,213 A * 10/1976 Kelso ..... B24B 1/00 451/53
5,390,446 A * 2/1995 Kazui ..... B24B 1/00 451/41

(Continued)

FOREIGN PATENT DOCUMENTS

EP 1063058 A2 12/2000
EP 0903200 B1 4/2004

(Continued)

OTHER PUBLICATIONS

International Search Report for PCT/US2014/071954 dated Apr. 9, 2015.

*Primary Examiner* — Dung Van Nguyen
(74) *Attorney, Agent, or Firm* — Abel Law Group, LLP; Joseph P. Sullivan

(57) ABSTRACT

A system for removing material from a workpiece comprising: a mounted-point grinding tool configured to move from a first position to a second position traversing at least a portion of a slot in a workpiece and removing material from a surface of the workpiece; and a first nozzle configured to deliver coolant to the mounted-point grinding tool, wherein the first nozzle is configured to move with the mounted point grinding tool from the first position to the second position so that the distance between the first nozzle and the mounted-point grinding tool remains substantially unchanged. A second nozzle can be mounted on the opposite side of tool from first nozzle, with the second nozzle also configured to move with the grinding tool so that the distance between the first nozzle and the mounted-point grinding tool remains substantially unchanged during grinding.

20 Claims, 9 Drawing Sheets

(56) References Cited

U.S. PATENT DOCUMENTS

| | | | | |
|---|---|---|---|---|
| 6,152,803 | A * | 11/2000 | Boucher | B23D 59/002 125/12 |
| 7,708,619 | B2 | 4/2010 | Subramanian et al. | |
| 7,722,691 | B2 | 5/2010 | Orlhac et al. | |
| 7,789,732 | B2 | 9/2010 | Grady et al. | |
| 7,896,728 | B2 * | 3/2011 | Schwartz | B24B 19/14 451/48 |
| 7,927,189 | B2 | 4/2011 | Grady et al. | |
| 8,449,353 | B2 | 5/2013 | Dremel et al. | |
| 8,641,479 | B2 * | 2/2014 | Stephenson | B24B 5/06 451/450 |
| 2007/0141961 | A1 * | 6/2007 | Brown | B24B 9/10 451/44 |
| 2007/0275641 | A1 | 11/2007 | Subramanian et al. | |
| 2009/0047875 | A1 | 2/2009 | Pilkington | |
| 2012/0034847 | A1 | 2/2012 | Besse et al. | |
| 2013/0072095 | A1 | 3/2013 | Hoerner | |

FOREIGN PATENT DOCUMENTS

| | | | |
|---|---|---|---|
| EP | 1142652 | B1 | 8/2005 |
| EP | 2025453 | B1 | 11/2010 |
| WO | 2008/106676 | A1 | 9/2008 |

* cited by examiner

COOLANT DELIVERY SYSTEM FOR GRINDING APPLICATIONS

CROSS-REFERENCE TO RELATED APPLICATION(S)

The present application claims priority from U.S. Provisional Patent Application No. 61/922,314, filed Dec. 31, 2013, entitled "COOLANT DELIVERY SYSTEM FOR GRINDING APPLICATIONS," naming inventors Bruce A. Roberge, Jr., John S. Hagan and David C. Graham, and said provisional application is incorporated by reference herein in its entirety for all purposes.

FIELD OF THE DISCLOSURE

The present invention relates in general to a coolant delivery system for grinding applications, and more particularly to a coolant delivery system configured to supply coolant to a mounted-point grinding tool during rapid material removal via creep-feed grinding.

BACKGROUND

Creep-feed grinding is a full depth or full cut operation that often allows a complete profile depth to be cut from a solid material in a single pass. For smaller workpieces, the material to be machined is fed past a rotating grinding tool, typically a grinding wheel, at a constant speed. For larger pieces, the material to be machined can remain stationary and the grinding tool can be moved.

A high removal rate can be achieved using creep-feed grinding, but the process can generate sufficient frictional heat to burn the workpiece surface and damage the wheel. Coolant liquid is typically supplied to the grinding tool contact region ensuring workpiece cooling and grinding tool cooling and efficient cleaning. It is known to use nozzles having one or more jets to deliver coolant to the wheel surface in large volumes.

Removal of metal or other material from a workpiece at high rates can require a significant quantity of coolant that must be delivered precisely and in sufficient quantities at, and across the entire profile of, the interface between the metal working tool and the workpiece. Typically, the coolant nozzle is positioned manually by an operator based on experience and an estimate of an orientation and position that will deliver the coolant stream at the metalworking tool. The significant volume and pressure of the stream of coolant during a grinding operation, for example, floods the grinding compartment and obscures any view of the exact position of the coolant stream's impact and of the machining interface. Often, if the coolant stream has not been precisely delivered to the machining interface, the machined workpiece will have flaws due to excessive heat buildup or material removal, and must be reworked or scrapped.

It is sometimes desirable to use creep-feed grinding to form complex shapes such as re-entrant shapes, which are forms that are wider at the inside than it is at the entrance (e.g., a dovetail joint). Turbine components, such as jet engine, rotors, compressor blade assembly, typically employ re-entrant shaped slots in the turbine disks. The re-entrant shape is used to hold or retain turbine blades around the periphery of turbine disks. Mechanical slides, T-slots to clamp parts on a machine table also use such re-entrant shaped slots.

This type of form cannot generally be created by grinding with a large diameter wheel operated perpendicular to the surface of the part because it would be impossible for the wheel to enter the wider part of the form without removing the narrower part of the form. Instead, these types of features, such as for example the re-entrant shaped slots used to hold or retain turbine blades, can be formed in a two-step process. First a slot is formed into the workpiece, and then a finishing process can be conducted to change the contour of the slot to a complex shape (e.g., re-entrant shape). Instead of a perpendicular grinding wheel, the slot finishing process can be processed with a mounted-point grinding tool that extends into the slot and rotates in a direction substantially parallel to the surface of the workpiece.

In forming re-entrant shapes via creep-feed grinding, one common problem is that it is difficult to position coolant nozzles so that the coolant reaches the entire grinding tool/workpiece interface. Because the shapes are wider inside than at the surface, nozzles located above the surface of the workpiece cannot be directed at the entire interface between the grinding tool and the workpiece. As a result, nozzles are typically mounted so that they are aimed at either end of the slot to be machined, with a first nozzle at the front of the tool (so that on a first grinding pass, the tool is moved toward the first nozzle during grinding) and a second nozzle located behind the tool (so that the tool is moved away from the second nozzle). Significantly, the nozzles are mounted so that they retail a constant orientation with respect to the workpiece, but the distant between the nozzles and the grinding tool changes constantly during the grinding process.

Unfortunately, large coolant flow rates and pressures are required to make up for the distance traveled by the coolant when the tool is farthest away from a given nozzle. This results in both increased coolant usage and a requirement for more sophisticated coolant delivery systems.

Thus, the industry continues to demand improvements in the delivery of coolant to grinding tools.

SUMMARY

A system for removing material from a workpiece is disclosed, the system comprising: a mounted-point grinding tool configured to move from a first position to a second position traversing at least a portion of a slot in a workpiece and removing material from a surface of the workpiece; and a first nozzle configured to deliver coolant to the mounted-point grinding tool, wherein the first nozzle is configured to move with the mounted point grinding tool from the first position to the second position so that the distance between the first nozzle and the mounted-point grinding tool remains substantially unchanged.

In another aspect, at least a portion of the first nozzle extends into the slot as the mounted-point grinding tool removes material from the surface of the workpiece.

In yet another aspect, the first nozzle includes a coolant delivery opening through which coolant is delivered to the mounted-point grinding tool and wherein the first nozzle is positioned so that the coolant delivery opening is within the slot as the mounted-point grinding tool removes material from the surface of the workpiece.

A method of removing material from a workpiece is also disclosed, the method comprising: moving a mounted-point grinding tool from a first position to a second position and traversing at least a portion of a slot in a workpiece and removing material from a surface of the workpiece; and moving a first nozzle configured to deliver coolant to the mounted point grinding tool from a first position to a second position, wherein during moving, a first gap distance between the first nozzle and the mounted point grinding tool remains substantially unchanged.

The foregoing has outlined rather broadly and in non-limiting fashion the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the scope of the invention as set forth in the appended claims.

BRIEF DESCRIPTION OF THE DRAWINGS

The present disclosure may be better understood, and its numerous features and advantages made apparent to those skilled in the art by referencing the accompanying drawings.

The accompanying drawings are not intended to be drawn to scale. In the drawings, each identical or nearly identical component that is illustrated in various figures is represented by a like numeral. For purposes of clarity, not every component may be labeled in every drawing.

DETAILED DESCRIPTION OF PREFERRED EMBODIMENTS

The following disclosure is directed to an improved coolant delivery system configured to supply coolant for grinding operations. In particular embodiments, at least one coolant nozzle in configured to move with a grinding tool, such as a mounted-point grinding tool extending into a slot in a workpiece and used to remove materials from the wall(s) of the slot. It will be appreciated that because the coolant nozzle moves with the grinding tool, the distance between the nozzle and the grinding tool remains substantially unchanged as the tool processes the workpiece, which allows for more efficient use of coolant. In particular embodiments, at least one coolant nozzle extends into the slot in the workpiece being processed so that coolant can be applied directly to the grinding interface even when the slot is being finished to a re-entrant shape.

As discussed above, turbine components, such as jet engine, rotors, compressor blade assembly, typically employ re-entrant shaped slots in the turbine disks. The re-entrant shape can be used to hold or retain turbine blades around the periphery of turbine disks. As used herein, the term "re-entrant shape" refers to a shape (e.g., of an opening within a workpiece) or a shape of a part (e.g., a bonded or plated abrasive body) that is wider at an inner axial position than at an outer axial position (i.e., an entrance). An example of the re-entrant shape is a dovetail slot, a keystone shape, and the like. Mechanical slides, T-slots to clamp parts on a machine table also use such re-entrant shaped slots.

Re-entrant shapes cannot generally be created by grinding with the typical large diameter grinding wheel operated perpendicular to the surface of the part because it would be impossible for the wheel to enter the wider part of the form without removing the narrower part of the form. Instead, these types of features, such as for example the re-entrant shaped slots used to hold or retain turbine blades, can be formed in a two-step grinding process.

Figure 1A:
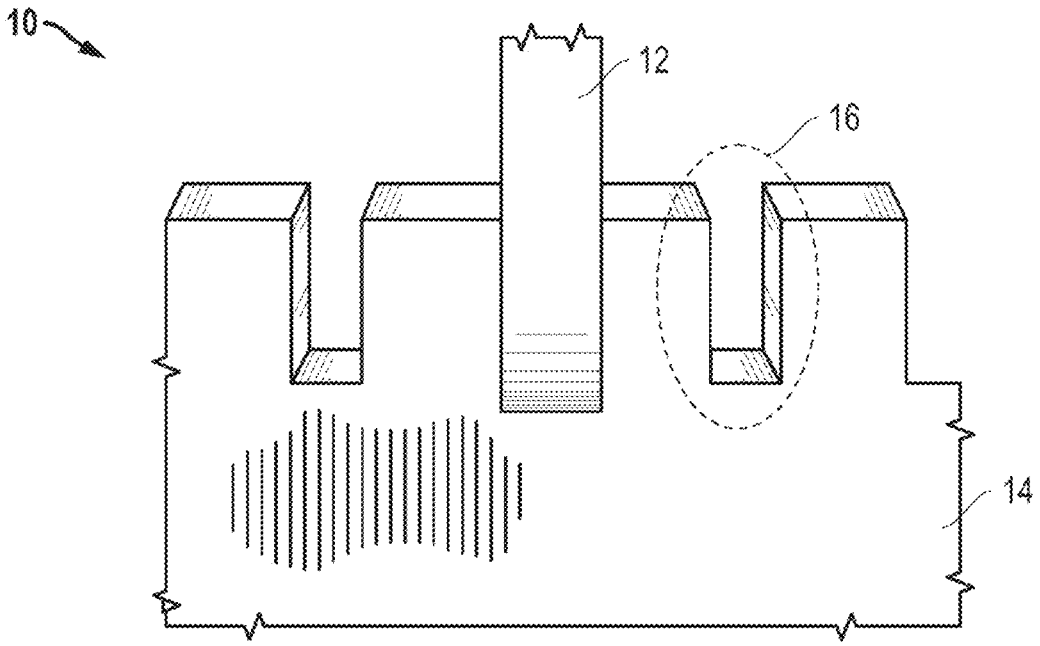
FIG. 1A includes an illustration of a conventional slot formation process 10.
Figure 1B:
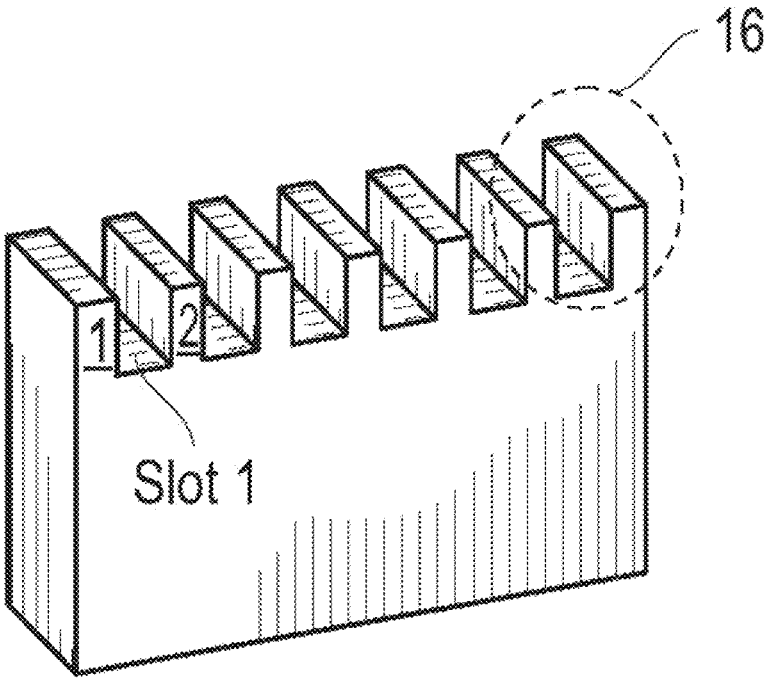
FIG. 1B shows a schematic representation of slots that can be generated by the slot formation process.

First, a slot is formed into the workpiece, usually by using a typical grinding wheel to remove material at the desired slot location and form an opening in the workpiece. FIG. 1A includes an illustration of a conventional slot formation process 10. As illustrated, the slot formation process can be a creep-feed grinding process utilizing a grinding wheel 12, oriented perpendicular to the surface of the workpiece 14, thereby forming slot(s) 16 in workpiece 14. FIG. 1B shows a schematic representation of slots that can be generated by the slot formation process.

Next, a finishing process can be conducted to change the contour of the rough slot to a more complex shape (e.g., a re-entrant shape). Instead of a perpendicular grinding wheel, a mounted-point grinding tool can be used to finish the slot. As described in greater detail below, such a mounted-point grinding tool extends into the slot that rotates in a direction substantially parallel to the surface of the workpiece to remove material from the walls of the slot and form the desired re-entrant shape.

Figure 2A:
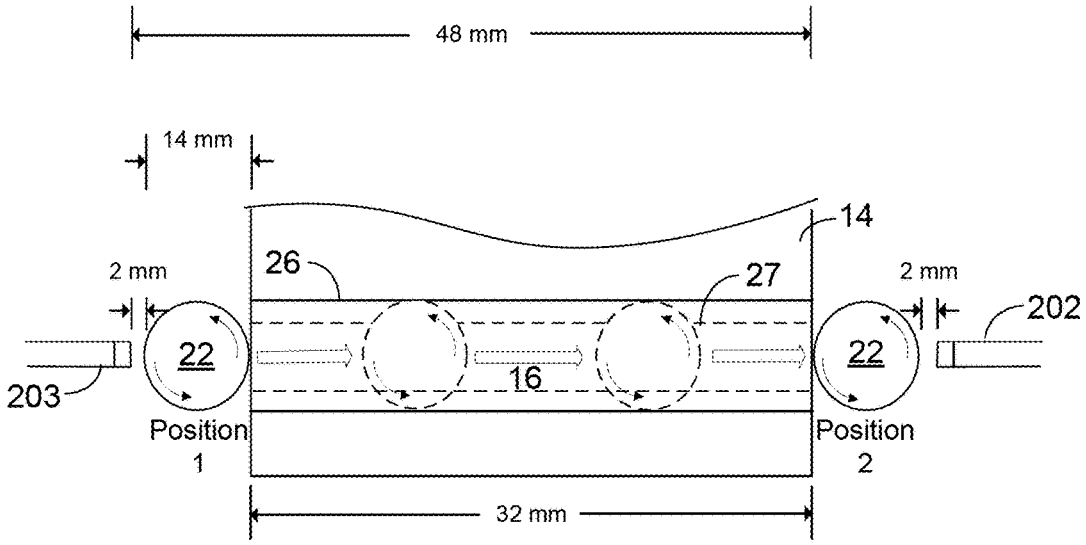
FIG. 2A, which is a schematic drawing illustrating a top down view of a conventional slot finishing process.

High speed grinding operations, such as these types of slot and finishing operations, typically require a coolant liquid to be applied to the grinding interface to avoid damage to the workpiece from friction induced heat. For conventional finishing operations, as discussed above, coolant liquid is typically supplied through one or two nozzles located at the ends of the previously formed slot. Such an arrangement is shown in FIG. 2A, which is a schematic drawing illustrating a top down view of a conventional slot finishing process. In FIG. 2A, a first nozzle 202 and a second nozzle 203 are mounted at either end of a slot 16 to provide coolant to the grinding surface. The original sidewalls of slot 16 are shown by dashed line 26, while the sidewalls after processing with the grinding tool are shown by lines 27. As used herein, the "grinding surface" refers to the interface between the grinding tool and the workpiece as the grinding tool rotates to process the surface. Nozzles 202, 203 are typically mounted so that they are aimed inward from either end of the slot to be machined. First nozzle 202 is positioned at the front of the tool so that on a first grinding pass, the tool is moved toward the first nozzle during grinding. Second nozzle 203 is positioned behind the grinding tool so that on a first grinding pass, the grinding tool is moved away from the second nozzle during grinding. As used herein, the nozzle located in front of the grinding tool can also be referred to as the leading nozzle, and the nozzle positioned behind the grinding tool can be referred to as the trailing nozzle. In the schematic illustration of FIG. 2A, the grinding tool 22 begins processing the workpiece at Position 1 and moves down the slot toward Position 2 in the direction shown by arrows 201 (from left to right in the orientation shown by FIG. 2A). In will be appreciated that on subsequent grinding passes, the grinding tool might move in the reverse direction, resulting in nozzle 203 being the leading nozzle and nozzle 202 the trailing nozzle on such a subsequent grinding pass.

Significantly, the first nozzle 202 and second nozzle 203 are typically mounted so that they retain a constant orientation with respect to the workpiece, while the distance between the nozzles and the grinding tool changes constantly during the grinding process. In the view of FIG. 2A, at the beginning of a grinding pass, the grinding tool 22 is located at Position 1. In order to process the workpiece by removing material from the inner walls of slot 16, grinding tool 22, which is rotating in the direction shown by arrows 20) moves from Position 1 on the first side of the slot to Position 2 on the other side (from left to right in the view of FIG. 2A). In the embodiment shown in FIG. 2A, at Position 1, the distance between the grinding tool 22 and second nozzle 203 is 2 mm. By the time grinding tool reaches Position 2, however, the distance between the grinding tool 22 and second nozzle 203 is 48 mm. Much higher coolant flow rates and pressures are required to supply an adequate amount of coolant to a grinding tool across a distance of 48 mm than would be required across a distance of only 2 mm. Supplying coolant across a greater distances requires both more a sophisticated coolant delivery system and a larger amounts of coolant than would be required if the nozzles were located closer to the grinding tool.

Figure 2B:
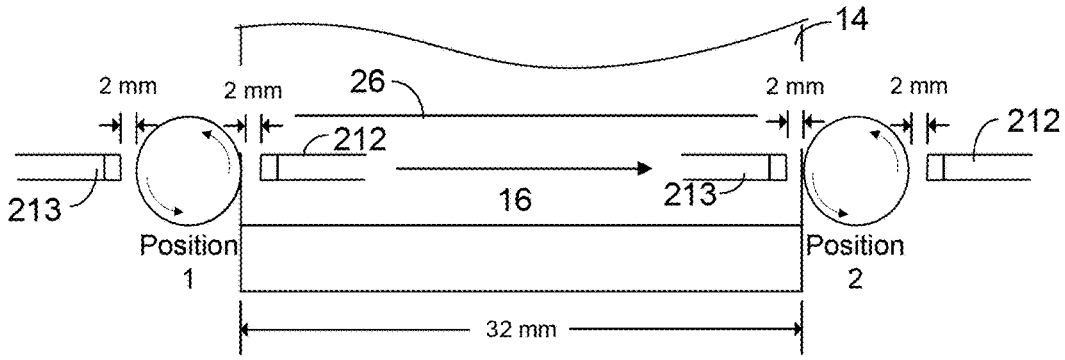
FIG. 2B is a schematic drawing illustrating a top down view of a finishing process according to embodiments described herein.

FIG. 2B is a schematic drawing illustrating a top down view of a finishing process according to embodiments described herein where the coolant nozzles are configured to move with the grinding tool as it processes the workpiece. In FIG. 2, a mounted-point grinding tool 22 is configured to move from a first position to a second position traversing at least a portion of a slot 22 in a workpiece to remove material from the wall(s) of the slot to create a slot having a complex or re-entrant shape. As in FIG. 2A, the original sidewalls of slot 16 are shown by dashed line 26, while the sidewalls after processing with the grinding tool are shown by lines 27.

First nozzle 222 is configured to deliver coolant to the mounted-point grinding tool. In some embodiments, such as the one illustrated in FIG. 2B, a second nozzle 223 is also configured to deliver coolant to the mounted-point grinding tool. Instead of being mounted in position relative to the workpiece, however, first nozzle 222 and second nozzle 223 (if present) are mounted so that they move with the mounted point grinding tool 22 from the first position to the second position (from left to right in the orientation shown by FIG. 2B).

In the view of FIG. 2B, at the beginning of a grinding pass, the grinding tool 22 is located at Position 1. In order to process the workpiece by removing material from the inner walls of slot 16, grinding tool 22, which is rotating in the direction shown by arrows 20) moves from Position 1 on the first side of the slot to Position 2 on the other side (from left to right in the view of FIG. 2B). As shown in FIG. 2A, at Position 1, the distance between the grinding tool 22 and second nozzle 203 is 2 mm. The distance between the grinding tool 22 and first nozzle 203 is also 2 mm. As the grinding tool 22 processes the sample by moving from Position 1 on the first side of the slot to Position 2 on the other side, the distance between the first and second nozzles and the grinding tool remain substantially unchanged. This can be accomplished, for example, by mounting nozzles 1 and 2 to the same mounting plate that supports the grinding tool.

It will be appreciated that 2 mm is an exemplary value only and that the distance could be set at any suitable value, for example from about 1 mm to about 15.2 cm. The distance at which the nozzles are most effective at supplying coolant is a function of the quality of the nozzle itself. The more coherent the jet, the further the nozzle can be from the grind zone without degrading process performance.

It will be appreciated that because the nozzles can be mounted so that they are so close to the grinding tool (within 2 mm in the embodiment of FIG. 2B) and because that distance between nozzle and tool remains constant, a material removal system according to embodiments described herein can make more efficient use of coolant. In some embodiments, the coolant delivery system can also be less complicated and operate at somewhat lower flow rate because the coolant does not have to be sprayed over larger distance and/or a distance that is changing as the grinding process is carried out.

Further, in particular embodiments, at least one coolant nozzle extends into the slot as the workpiece is being processed. In the embodiment of FIG. 2B, both the first and second nozzles 222, 223 extend into the slot 16 during at least a portion of the workpiece processing. In some instances, the entire nozzle structure can be located with the slot, while in others only a portion of the nozzle will extend into the slot. It will be appreciated that the entire nozzle structure need not be located inside the slot as long the portion of the nozzle that does extends into the slot includes one or more nozzle exit openings configured to allow the passage of coolant from the nozzle. This allows the coolant can be directed at the entire grinding tool/workpiece interface even when the slot is being finished to a re-entrant shape.

Figure 2C:
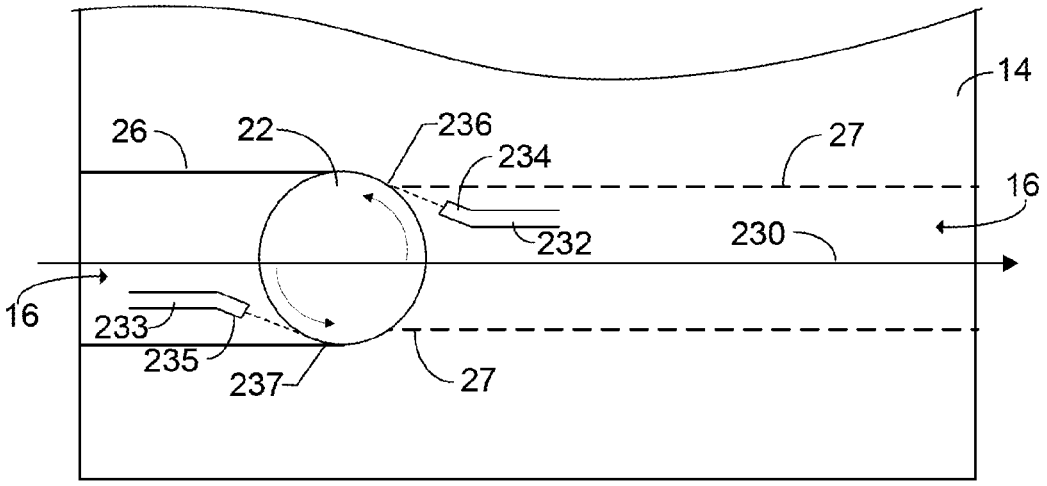
FIG. 2C is a schematic drawing illustrating a top down view of a finishing process according to another embodiment.

In some embodiments, the portion of the nozzle that extends into the slot can comprise an end portion including a nozzle exit opening that can be aimed at the grinding tool/workpiece interface to deliver coolant to a desired location. FIG. 2C is a schematic drawing illustrating a top down view of a finishing process according to embodiments described herein where the end portions 234, 235 of the coolant nozzles 232, 233 are angled relative to the grinding tool path 230 so that the coolant can be directed at the points of tangency 236, 237 between the rotating tool 22 and the sidewalls 27 of the slot 16 in the workpiece 14.

As discussed in more detail below, in some embodiments, a single coolant nozzle may include a plurality of jets, each jet aimed so that it focuses a stream of coolant to a particular portion of the grinding tool. Because the orientation and distance between the nozzle (and thus the jets) does not substantially change during a grinding operation according to embodiments described herein, the aim or direction of the nozzle(s) and/or jets does not need to be changed or adjusted during the grinding operation.

A method of processing a workpiece using the embodiments of a coolant delivery system according to embodiments herein will now be described. A grinding tool used to conduct the slot formation and the finishing process according to embodiments described herein can be part of high efficiency grinding apparatus, including multi-axis machining centers. With a multi-axis machining center, both the slot formation and the complex shape finishing process can be carried out on the same machine. Suitable grinding machines are commercially available, including, e.g., a Campbell 950H horizontal axis grinding machine apparatus, available from Campbell Grinding Company, Spring Lake, Mich.

The grinding processes described herein can be completed on a wide variety of materials, including materials that are very hard and difficult to process by other methods. For example, workpieces can be metallic, and particularly metal alloys such titanium, Inconel (e.g., IN-718), steel-chrome-nickel alloys (e.g., 100 Cr6), carbon steel (AISI 4340 and AISI 1018) and combinations thereof.

As described above with reference to FIGS. 1A and 1B, an initial slot formation process can be undertaken, which forms one or more openings or slots 16 in the workpiece 14. While such an initially formed slot will not have the desired final contour (i.e., complex shape), this initial slot formation process can remove the bulk of material, minimizing the amount of material to be removed in the complex shape finishing process described below. As shown in FIG. 1A, the initial slots can be formed at the desired locations by a creep-feed grinding process utilizing a grinding wheel 12, oriented perpendicular to the surface of the workpiece 14, to remove material and create one or more slot(s) 16.

In the slot formation process, the grinding wheel can be a bonded or plated abrasive tool. Particular details of a bonded abrasive tool suitable for use in the slot forming process are provided in U.S. Pat. No. 7,722,691 and U.S. Pat. No. 7,708,619, the teachings of which are incorporated herein by reference. The creep-feed grinding can be conducted at grinding speed in a range between about 30 m/s and about 150 m/s.

Next, a finishing process can be conducted to change the contour of the rough slot to a more complex shape (e.g., a re-entrant shape). Instead of a perpendicular grinding wheel, a mounted-point grinding tool can be used to finish the slot. As described in greater detail below, such a mounted-point grinding tool extends into the slot that rotates in a direction substantially parallel to the surface of the workpiece to remove material from the walls of the slot and form the desired re-entrant shape.

Figure 3A:
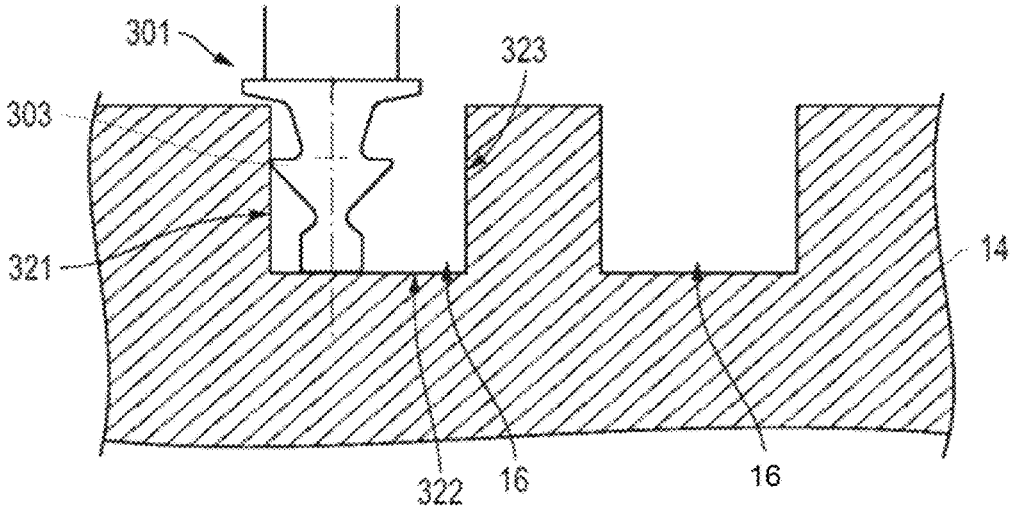
FIGS. 3A and 3B illustrate a finishing operation using an abrasive tool according to an embodiment.
Figure 3B:
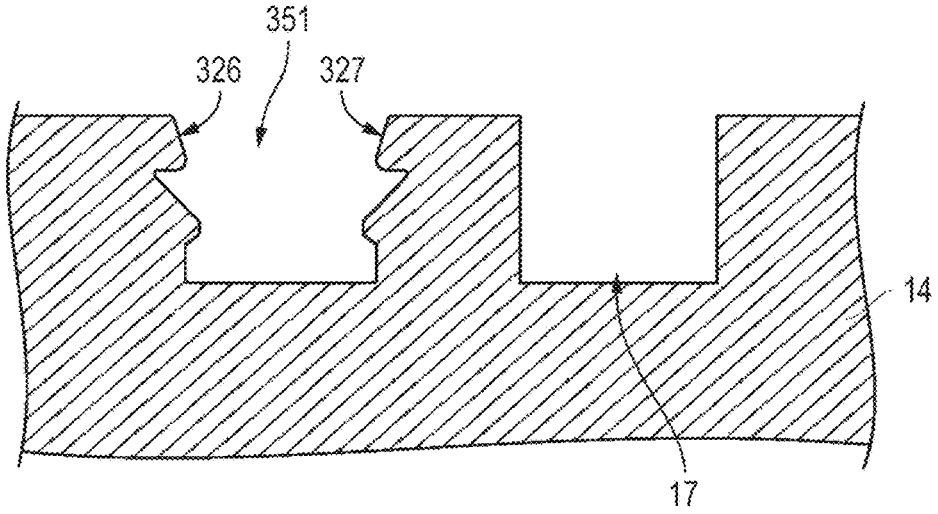

FIGS. 3A and 3B illustrate a finishing operation using a grinding tool according to an embodiment. In particular, FIG. 3A illustrates a finishing operation to form a complex shape within the slot 16 of the workpiece 14 with an abrasive tool 301 in the form of a mounted point tool. The abrasive tool 301 can have a complex shape suitable for producing a corresponding complex shape within the workpiece 14. That is, the abrasive body 303 can have a shape that is the inverse of a complex shape, to be imparted into the workpiece 14.

In accordance with embodiments herein, the grinding tool 301 can have a bonded abrasive body 303 including abrasive grains contained within a matrix of bonding material. The abrasive grains can include super-abrasive materials, such as cubic boron nitride, diamond, and a combination thereof. The grinding tool 301 can also plated abrasive body.

The grinding tool of bonded or plated abrasive can be formed such that it has an abrasive body incorporating abrasive grains having an average grit size of not greater than about 300 microns. In some embodiments, the abrasive grains can have an average grit size of not greater than about 125 microns, such as not greater than about 100 microns, or even not greater than about 95 microns. In particular instances, the abrasive grains have an average grit size within a range between about 10 microns and 300 microns, such as between about 20 microns and 120 microns, or even between about 20 microns and 100 microns.

With regard to the bonding material within a bonded abrasive body 303, suitable materials can include organic materials, inorganic materials, and a combination thereof. For example, suitable organic materials may include polymers such as resins, epoxies, and the like. Suitable inorganic bond materials can include metals, metal alloys, ceramic materials, and a combination thereof. For example, some suitable metals can include transition metal elements and metal alloys containing transition metal elements. In other embodiments, the bond material may be a ceramic material, which can include polycrystalline and/or vitreous materials. Suitable ceramic bonding materials can include oxides, including for example, $SiO_2$, $Al_2O_3$, $B_2O_3$, MgO, CaO, $Li_2O$, $K_2O$, $Na_2O$ and the like. Further, it will be appreciated that the bonding material can be a hybrid material that is a combination of organic and inorganic components. Some suitable hybrid bond materials can include metal and organic bond materials.

In accordance with at least one embodiment, the bonded abrasive body 303 can include a composite including bond material, abrasive grains, and some porosity. For example, the bonded abrasive body 303 can have at least about 3 vol % abrasive grains (e.g., superabrasive grains) of the total volume of the bonded abrasive body. In other instances, the bonded abrasive body 303 can include at least about 6 vol %, at least about 10 vol %, at least about 15 vol %, at least about 20 vol %, or even at least about 25 vol % abrasive grains. Particular bonded abrasive tools 301 can be formed to include between about 2 vol % and about 60 vol %, such as between about 4 vol % and about 60 vol %, or even between about 6 vol % and about 54 vol % superabrasive grains.

The bonded abrasive body 303 can be formed to have at least about 3 vol % bond material (e.g., vitrified bond or metal bond material) of the total volume of the bonded abrasive body. In other instances, the bonded abrasive body 303 can include at least about 6 vol %, at least about 10 vol %, at least about 15 vol %, at least about 20 vol %, or even at least about 25 vol % bond material. Particular bonded abrasive bodies 303 can include between about 2 vol % and about 60 vol %, such as between about 4 vol % and about 60 vol %, or even between about 6 vol % and about 54 vol % bond material.

The bonded abrasive body 303 can be formed to have a certain content of porosity, and particularly an amount of not greater than about 60 vol % of the total volume of the bonded abrasive body. For example, the bonded abrasive body 303 can have not greater than about 55 vol %, such as not greater than about 50 vol %, not greater than about 45 vol %, not greater than about 40 vol %, not greater than about 35 vol %, or even not greater than about 30 vol % porosity. Particular bonded abrasive bodies can have a certain content of porosity, such as between about 0.5 vol % and about 60 vol %, such as between about 1 vol % and about 60 vol %, between about 1 vol % and about 54 vol %, between about 2 vol % and about 50 vol %, between about 2 vol % and about 40 vol %, or even between about 2 vol % and about 30 vol % porosity.

During the finishing process, a grinding tool 301 including a bonded abrasive body 303 can be placed in contact with the workpiece 14, and more particularly within the slot 16 previously formed within the workpiece 14. In accordance with an embodiment, the grinding tool 301 can be rotated at a significantly high speed to finish and re-contour the surfaces 321 and 323 of the slot 16 to form a complex shape 351 within the workpiece 14. For example, the grinding tool can be rotated at speeds of at least about 10,000 rpm, although any rotation speed sufficient to remove material and form the desired complex shape could be used with the embodiments described herein.

Coolant liquid is supplied to the grinding tool during the grinding process to prevent friction induced heat from damaging the workpiece. Any suitable coolant may be used, including water-soluble coolants, non-water-soluble coolants, semi-synthetic coolants, synthetic coolants, and/or oil-based coolants. As described above, first and second coolant nozzles are mounted so that the nozzle outlets are located relatively close to the grinding tool (for example, at a distance of 2 mm) and configured to move with the grinding tool as it processes the workpiece.

The grinding tool 301 can be moved along a longitudinal axis of the slot being processed to facilitate finishing of the surface 321 to a suitable, complex shape. For example, referring also to FIG. 2B, the grinding tool can be introduced to the slot at a first position (Position 1) corresponding to one edge of the slot and can then be moved along the longitudinal axis of the slot (while being rotated to grind away material from the walls of the slot) to a second position (Position 2) at the other side of the slot. In this way, the grinding tool processes the entire length of the slot. In some embodiments, the grinding tool processes both sides of the slot in a single pass. In other embodiments, additional passes through the slot are required. For example, the grinding tool might process one sidewall of the slot on a first pass along the length of a slot, then be shifted laterally to contact the opposite sidewall and process the opposite sidewall on a second pass back along the length of the slot in the opposite direction. In other embodiments, the grinding tool might make three or more passes along the length of a slot.

Figure 4:
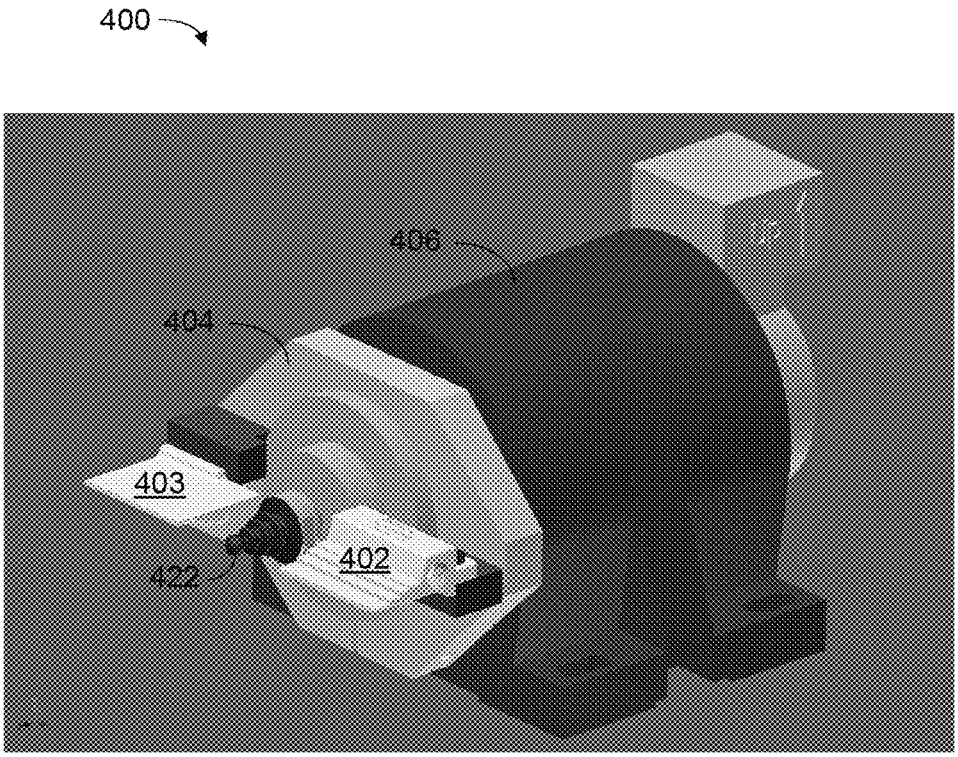
FIG. 4 is a perspective illustration of an embodiment in which two multi-jet nozzles are mounted on a common base and travel with the grinding tool according to embodiments described herein.

FIG. 4 is a perspective illustration of an embodiment in which two multi-jet nozzles 402, 403 are attached directly to a grinding apparatus 400 by way of a mounting plate 404 located between the grinding tool 422 used to grind the workpiece and the motor 406 used to rotate the abrasive body. Each of nozzles 402, 403 have a plurality of jets adapted to the profile of the grinding tool 422.

Figure 5:
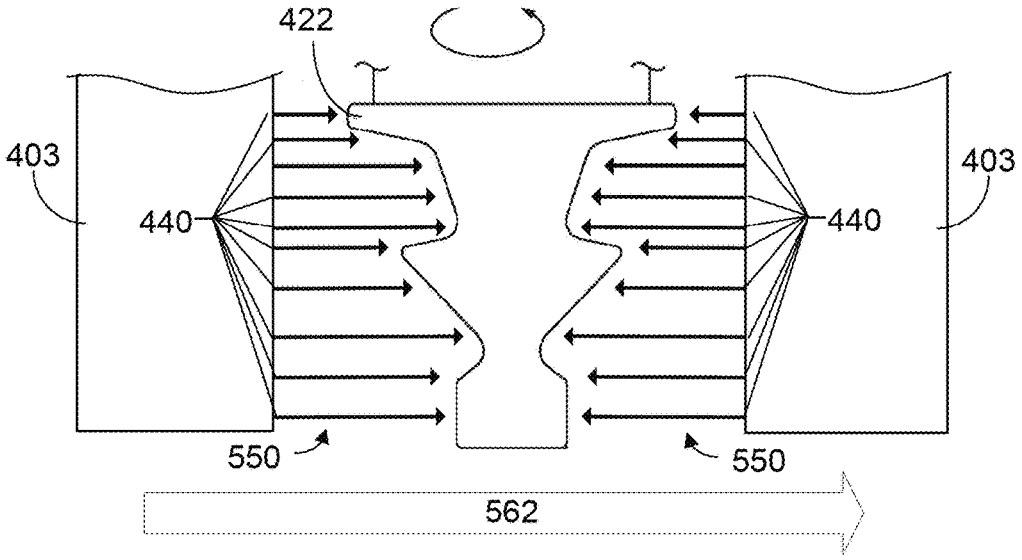
FIG. 5 is a schematic illustration of an arrangement of jets adapted to the profile of the abrasive body according to an embodiment.

FIG. 5 is a schematic illustration of an arrangement the jets, such as the ones shown in FIG. 4, which are adapted to the profile of the grinding tool. Each of the multi-jet nozzles 402, 403 has a plurality of jets 440, with each jet positioned so that it delivers coolant 550 to a particular portion of the grinding tool 422 as the grinding tool moves through a slot in the direction shown by arrow 552. In the embodiment of FIG. 4, the dual nozzles have inverted shapes so that each will apply coolant directly to the point of tangency much like the tubular nozzles with angled end portions shown in FIG. 2C.

Figure 6:
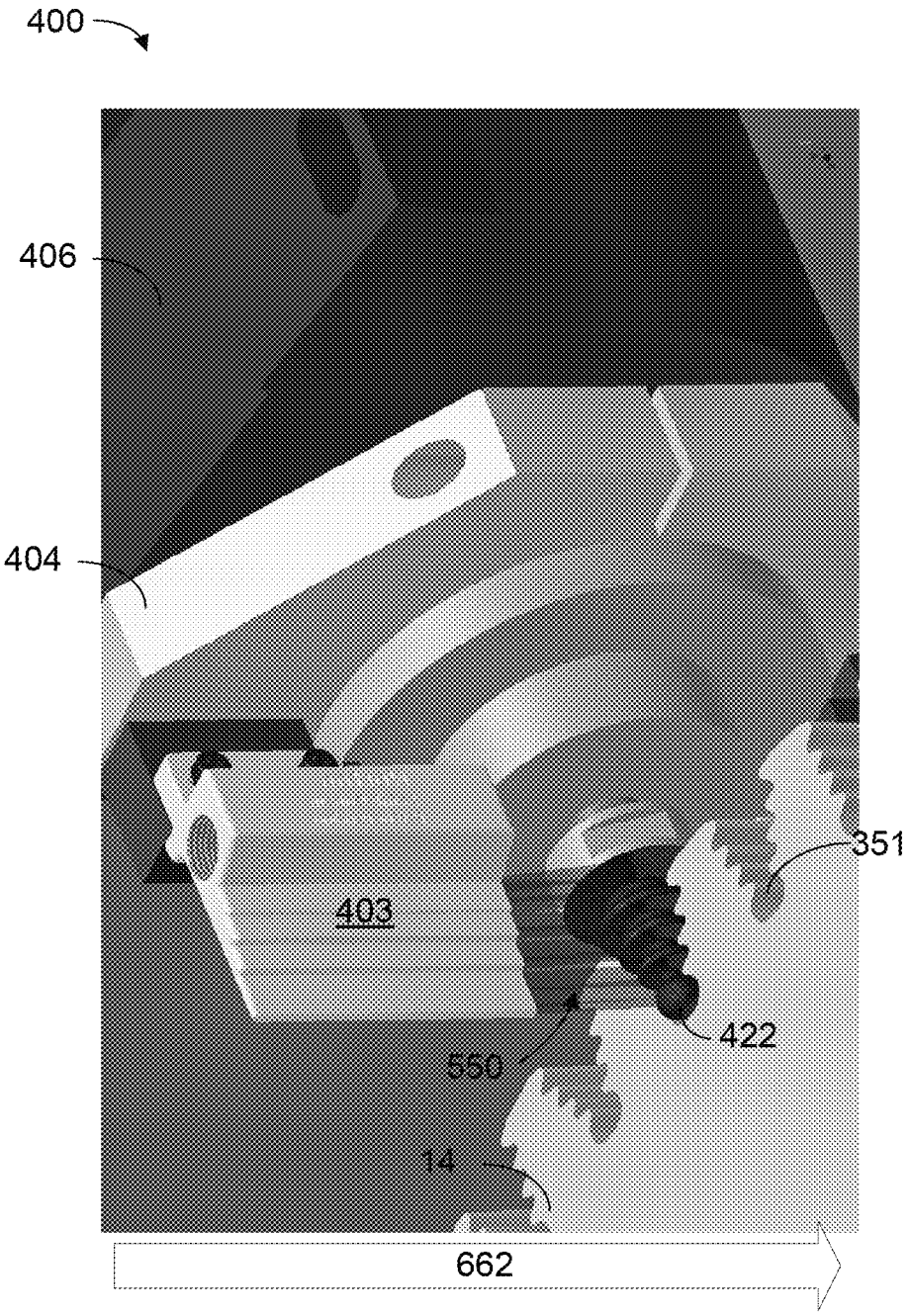
FIGS. 6 and 7 are perspective views of the grinding tool of FIG. 4 in use.
Figure 7:
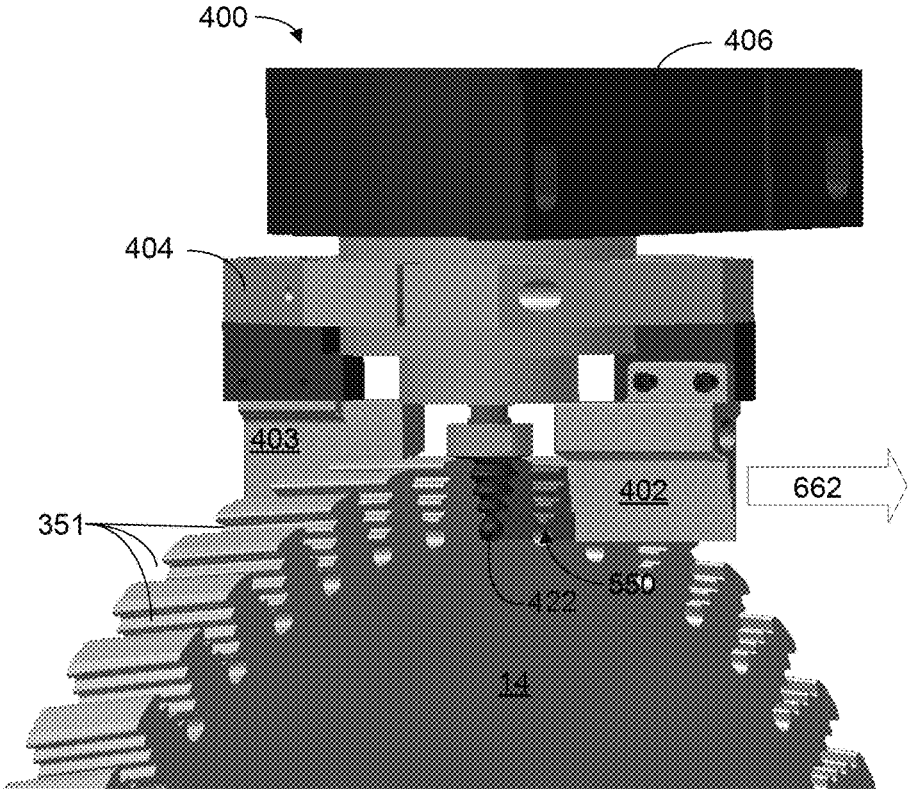

FIGS. 6 and 7 are perspective views of the grinding apparatus of FIG. 4 in use finishing a slot in a turbine disk so that the re-entrant shape of the finished slot can be used to hold or retain turbine blades around the periphery of the turbine disk. As shown in FIGS. 6 and 7, the multi-jet nozzles 402, 403 are attached directly to the grinding apparatus 400. As the grinding tool is moved into and through the slot to be processed (from left to right in the views of FIGS. 6 and 7 in the direction shown by arrow 651) nozzle 402 extends into the slot and precedes the grinding tool and it moves along the length of the slot. The jets of leading nozzle 402 are aimed away from the direction of movement and back toward the leading side of the grinding tool. Trailing nozzle 403 is mounted on the opposite side of the grinding tool, with its jets aimed forward toward the trailing side of the grinding tool.

In FIG. 6, the grinding tool is just entering the slot, leading nozzle 402 (not shown in this view) has already travelled the length of the slot in advance of the grinding tool, while trailing nozzle 403, which is directing coolant at the trailing side of the grinding tool, has not yet entered the slot. In FIG. 7, the grinding tool is just exiting the slot, having processed the entire length of the slot to form a complex re-entrant shape corresponding to the shape of the grinding tool abrasive body. Leading Nozzle 402 has already passed through the slot and completely exited. Trailing nozzle 403 is just beginning to enter the slot in the view of FIG. 7.

Significantly, the portion of each nozzle that extends into the slot passes completely through the entire length of the slot during the grinding process. The nozzles and the grinding tool are all arranged in a straight line, with the nozzles being sized and positioned to have sufficient clearance and their path being strictly controlled so that they will not contact the workpiece as they move through the slots. In some embodiments, the first and second nozzles will be configured to traverses a path between a first position at one edge of the slot to a second position at the other edge of the slot with substantially no vertical or lateral variance, such as with a vertical and/or lateral variance that is less than 1% or even less than 0.1%.

Once the grinding pass through the slot has been completed (or the final grinding pass for a multi-pass grinding process) the workpiece can be repositioned (or the grinding tool repositioned) so that the grinding tool can process another slot. This process is repeated until no more slots remain to be processed on the workpiece.

Figure 8:
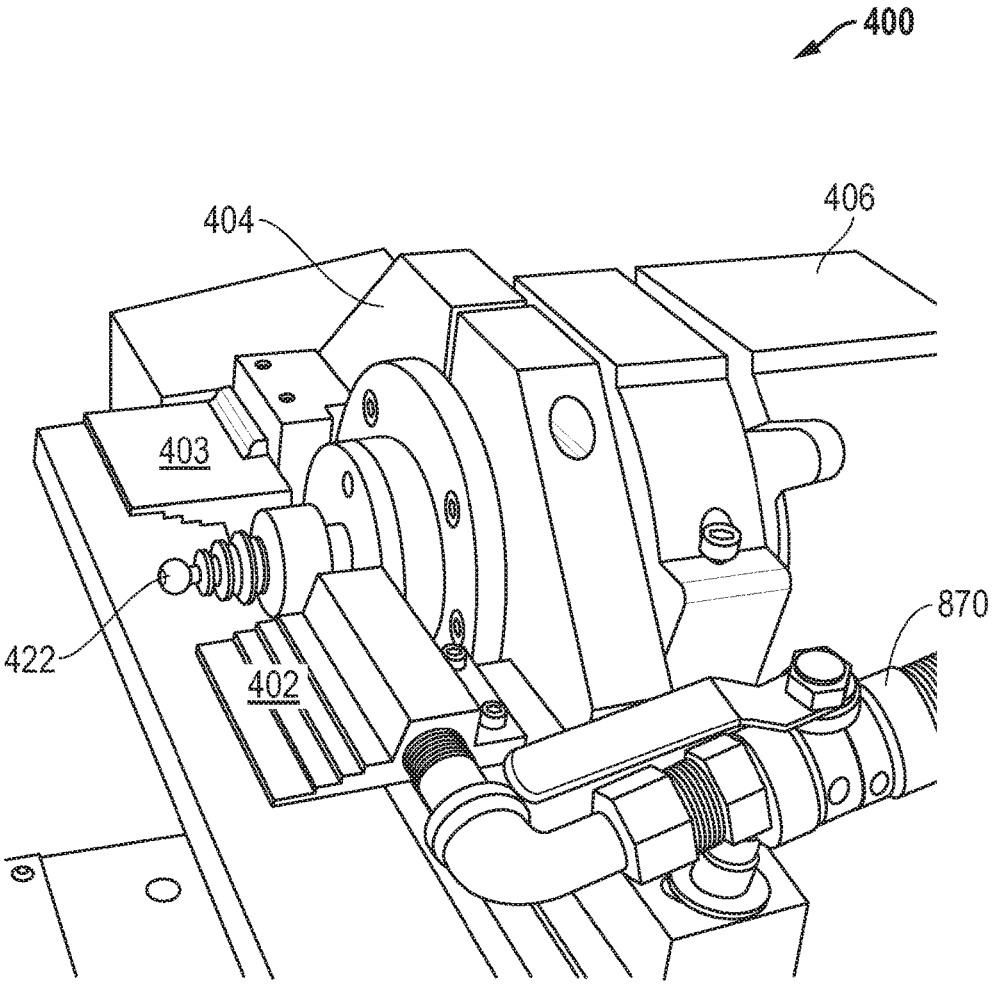
FIG. 8 is a photograph of a grinding tool according to embodiments described herein.

FIG. 8 a photograph of a grinding tool such as the grinding tool illustrated in FIG. 4. FIG. 8 also shows the connection of coolant delivery lines 870 to one of the nozzles.

Many different aspects and embodiments are possible. Some of those aspects and embodiments are described below. After reading this specification, skilled artisans will appreciate that those aspects and embodiments are only illustrative and do not limit the scope of the present invention. Embodiments may be in accordance with any one or more of the items as listed below.

Item 1. A system for removing material from a workpiece comprising:

a mounted-point grinding tool configured to move from a first position to a second position traversing at least a portion of a slot in a workpiece and removing material from a surface of the workpiece; and a first nozzle configured to deliver coolant to the mounted-point grinding tool, wherein the first nozzle is configured to move with the mounted point grinding tool from the first position to the second position so that the distance between the first nozzle and the mounted-point grinding tool remains substantially unchanged.

Item 2. The system of item 1, wherein at least a portion of the first nozzle extends into the slot.

Item 3. The system of item 1, wherein the first nozzle includes a coolant delivery opening through which coolant is delivered to the mounted-point grinding tool and wherein the first nozzle is positioned so that the coolant delivery opening is within the slot as the mounted-point grinding tool removes material from the surface of the workpiece.

Item 4. The system of any one of the preceding items, further comprising a second nozzle mounted on the opposite side of tool from first nozzle.

Item 5. The system of item 4, wherein at least a portion of the second nozzle extends into the slot.

Item 6. The system of item 4, wherein the second nozzle is configured to move with the mounted point grinding tool from the first position to the second position so that the distance between the second nozzle and the mounted-point grinding tool remains substantially unchanged.

Item 7. The system of any one of the preceding items wherein the targeting of the first nozzle and/or the second nozzle does not vary while the mounted-point grinding tool moves from the first position to the second position.

Item 8. The system of any one of the preceding items wherein the first nozzle and/or the second nozzle includes multiple jets through which a coolant stream is delivered.

Item 9. The system of item 8 in which each jet is aimed at a different portion of the mounted-point grinding tool.

Item 10. The system of item 8 in which the shape of the first nozzle and/or the second nozzle and the arrangement of the multiple jets corresponds to the shape of the tool.

Item 11. The system of any one of the preceding items wherein the first nozzle and/or the second nozzle includes multiple jets through which a coolant stream is delivered and in which the aiming of the jets does not change during the material removal process Item 12. The system of any one of the preceding items wherein the first nozzle is positioned on the front side of the mounted-point grinding tool so that the first nozzle precedes the mounted-point grinding tool through the slot as the mounted-point grinding tool moves from the first position to the second position.

Item 13. The system of any one of items 4-11 wherein the second nozzle is positioned on the back side of the mounted-point grinding tool so that the second nozzle follows the mounted-point grinding tool through the slot as the mounted-point grinding tool moves from the first position to the second position.

Item 14. The system of any one of the preceding items, wherein substantially unchanged includes a variation in the distance between the first nozzle and the mounted-point grinding tool of no more than about 0.5%.

Item 15. The system of any one of the preceding items, wherein the distance between the first nozzle and the mounted-point grinding tool is at least about 0.5" and not greater than about 5.0".

Item 16. The system of any one of the preceding items, wherein the first nozzle is configured to traverses a path between the first position to the second position with substantially no vertical variance.

Item 17. The system of any one of the preceding items, wherein the first nozzle is a tubular nozzle and the portion of the nozzle extending into the slot comprises an end portion at an angle with respect to a longitudinal axis of the grinding tool path.

Item 18. The system of item 17, wherein the portion of the nozzle extending into the slot further comprises an opening configured to allow the passage of coolant from the nozzle, wherein the opening is disposed at the angled end portion, and wherein the angle is sufficient to direct coolant passing out of the opening at the point of tangency between the rotating grinding tool and the workpiece surface.

Item 19. The system of item 5, wherein the portion of the second nozzle extending into the slot has an average length that is substantially the same as an average length of the portion of the first nozzle extending into the slot.

Item 20. The system of item 5, wherein the portion of the second nozzle has an average length that is significantly different compared to an average length of the portion of the first nozzle.

Item 21. The system of item 5, wherein the second nozzle is a tubular nozzle and the portion of the nozzle extending into the slot comprises an end portion at an angle with respect to a longitudinal axis of the grinding tool path.

Item 22. The system of item 21, wherein the portion of the second nozzle extending into the slot further comprises an opening configured to allow the passage of coolant from the second nozzle, wherein the opening is disposed at the angled end portion, and wherein the angle is sufficient to direct coolant passing out of the opening at the point of tangency between the rotating grinding tool and the workpiece surface.

Item 23. The system of item 4, wherein the second nozzle and first nozzle have essentially the same shape as compared to each other.

Item 24. The system of any one of the preceding items, wherein the first nozzle has a tapered cross-sectional shape, wherein the first nozzle has a distal end having a thickness greater than a terminal end.

Item 25. The system of any one of the preceding items, wherein the first nozzle comprises a stepped-tapered cross-sectional shape including a first portion having a first thickness and a second portion having a second thickness different than the first thickness, wherein the second thickness is less than the first thickness.

Item 26. The system of item 25, wherein the first portion comprises a first plurality of openings and the second portion comprises a second plurality of openings, wherein the first plurality of openings are laterally spaced apart from the second plurality of openings, wherein the first plurality of openings are disposed in a first plane and the second plurality of openings are disposed in a second plane, wherein the first plane and second plane are substantially parallel to each other and laterally spaced apart from each other.

Item 27. The system of item 25, further comprising a third portion having a third thickness, wherein the third thickness is different than the first thickness and the second thickness, wherein the third thickness is less than the first thickness, wherein the third thickness is less than the second thickness.

Item 28. The system of item 27, further comprising a fourth portion having a fourth thickness, wherein the fourth thickness is different than the first thickness, the second thickness, and the third thickness, wherein the fourth thickness is less than the first thickness, wherein the fourth thickness is less than the second thickness, wherein the fourth thickness is less than the third thickness.

Item 29. The system of item 25, wherein the first portion of the first nozzle is laterally adjacent a first portion of the mounted point grinding tool, and wherein the second portion of the first nozzle is laterally adjacent a second portion of the mounted point grinding tool, and wherein the first portion of the mounted point grinding tool has a first average diameter different than a second average diameter of the mounted point grinding tool associated with the second portion of the mounted point grinding tool, wherein the first average diameter is greater than the second average diameter.

Item 30. The system of any one of the preceding items, wherein the mounted point grinding tool comprises a complex shape comprising a first radial flange extending from a body of the mounted point grinding tool at a first axial position.

Item 31. A method for removing material from a workpiece comprising:

moving a mounted-point grinding tool from a first position to a second position and traversing at least a portion of a slot in a workpiece and removing material from a surface of the workpiece; and moving a first nozzle configured to deliver coolant to the mounted point grinding tool from a first position to a second position, wherein during moving, a first gap distance between the first nozzle and the mounted point grinding tool remains substantially unchanged.

Item 32. The method of item 31, wherein moving comprises finishing a complex shape in the workpiece, wherein the complex shape comprises a re-entrant shape.

Item 33. The method of item 31, wherein moving comprises grinding a rough slot to form a complex shape opening in the workpiece configured to operate as a rotor slot connection.

The invention described herein has broad applicability and can provide many benefits as described and shown in the examples above. The embodiments will vary greatly depending upon the specific application, and not every embodiment will provide all of the benefits and meet all of the objectives that are achievable by the invention. Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention. After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive- or and not to an exclusive- or. For example, a condition A or B is satisfied by any one of the following: A is true (or present) and B is false (or not present), A is false (or not present) and B is true (or present), and both A and B are true (or present). Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The Abstract of the Disclosure is provided to comply with Patent Law and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description, with each claim standing on its own as defining separately claimed subject matter.

Although the present invention and its advantages have been described in detail, it should be understood that various changes, substitutions and alterations can be made to the embodiments described herein without departing from the scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A system for removing material from a workpiece comprising:

a mounted-point grinding tool having a complex shape and configured to move from a first position to a second position within the system traversing at least a portion of a slot in a workpiece and configured to remove material from the slot to create a slot having a complex shape; and a first nozzle configured to deliver coolant to the mounted-point grinding tool, wherein the first nozzle is configured to move with the mounted point grinding tool from the first position to the second position so that the distance between the first nozzle and the mounted-point grinding tool remains substantially unchanged while removing material from the slot, wherein at least a portion of the first nozzle is configured to pass through a length of the slot as the mounted-point grinding tool moves from the first position to the second position while removing material from the slot, and wherein the first nozzle comprises a shape that corresponds to at least a portion of a profile of the mounted-point grinding tool.

2. The system of claim 1, wherein at least a portion of the first nozzle is configured to pass through an entire length of the slot.

3. The system of claim 1, wherein the first nozzle includes a coolant delivery opening through which coolant is delivered to the mounted-point grinding tool and wherein the first nozzle is positioned so that the coolant delivery opening is within the slot as the mounted-point grinding tool removes material from the slot.

4. The system claim 1, further comprising a second nozzle mounted on the opposite side of tool from first nozzle.

5. The system of claim 4, wherein at least a portion of the second nozzle extends into the slot.

6. The system of claim 4, wherein the second nozzle is configured to move with the mounted point grinding tool from the first position to the second position so that the distance between the second nozzle and the mounted-point grinding tool remains substantially unchanged.

7. The system of claim 6, wherein the second nozzle is positioned on the back side of the mounted-point grinding tool so that the second nozzle follows the mounted-point grinding tool through the slot as the mounted-point grinding tool moves from the first position to the second position.

8. The system of claim 1, wherein targeting of the first nozzle does not vary while the mounted-point grinding tool moves from the first position to the second position.

9. The system of claim 1, wherein the first nozzle includes multiple jets through which a coolant stream is delivered.

10. The system of claim 9, wherein each jet is aimed at a different portion of the mounted-point grinding tool.

11. The system of claim 1, wherein the first nozzle includes multiple jets through which a coolant stream is delivered and in which the aiming of the jets does not change during the material removal process.

12. The system of claim 1, wherein the first nozzle is positioned on the front side of the mounted-point grinding tool so that the first nozzle precedes the mounted-point grinding tool through the slot as the mounted-point grinding tool moves from the first position to the second position.

13. The system of claim 1, wherein substantially unchanged includes a variation in the distance between the first nozzle and the mounted-point grinding tool of no more than about 0.5%.

14. The system of claim 1, wherein the distance between the first nozzle and the mounted-point grinding tool is at least about 0.5" and not greater than about 5.0".

15. The system of claim 1, wherein the first nozzle is configured to traverses a path between the first position to the second position with substantially no vertical variance.

16. The system of claim 1, wherein the first nozzle is a tubular nozzle and the portion of the nozzle extending into the slot comprises an end portion at an angle with respect to a longitudinal axis of the grinding tool path.

17. The system of claim 1, wherein the shape of the first nozzle includes an inverted shape and configured to apply coolant directly to a point of tangency of the mounted-point grinding tool.

18. A system for removing material from a workpiece comprising:

a mounted-point grinding tool having an abrasive body having a complex shape, and configured to move from a first position to a second position within the system traversing at least a portion of a slot in a workpiece and further configured to remove material from the slot to create a slot having a complex shape;

a first nozzle configured to deliver coolant to the mounted-point grinding tool and to move with the mounted point grinding tool from the first position to the second position so that the distance between the first nozzle and the mounted-point grinding tool remains substantially unchanged while removing material from the slot;

a second nozzle configured to deliver coolant to the mounted-point grinding tool and to move with the mounted point grinding tool from the first position to the second position so that the distance between the second nozzle and the mounted-point grinding tool remains substantially unchanged, wherein the first nozzle is further configured to travel within the slot in advance of the mounted-point grinding tool as the mounted-point grinding tool moves from the first position to the second position while removing material from the slot, wherein the first nozzle, second nozzle, and the abrasive body of the mounted-point grinding tool are arranged in a straight line, and wherein each of the first nozzle and second nozzle comprises a shape that corresponds to at least a portion of a profile of the mounted-point grinding tool.

19. A system for removing material from a workpiece comprising:

a mounted-point grinding tool having a complex shape and configured to move from a first position to a second position within the system traversing at least a portion of a slot in a workpiece and configured to remove material from the slot to create a slot having a complex shape; and a first nozzle configured to deliver coolant to the mounted-point grinding tool, wherein the first nozzle is configured to move with the mounted point grinding tool from the first position to the second position so that the distance between the first nozzle and the mounted-point grinding tool remains substantially unchanged while removing material from the slot, wherein at least a portion of the first nozzle is configured to pass through a length of the slot as the mounted-point grinding tool moves from the first position to the second position while removing material from the slot;

wherein the first nozzle includes multiple jets through which a coolant stream is delivered, wherein each jet is aimed at a different portion of the mounted-point grinding tool, and wherein the first nozzle comprises a shape that corresponds to at least a portion of a profile of the mounted-point grinding tool.

20. The system of claim 19, wherein the shape of the first nozzle includes an inverted shape and configured to apply coolant directly to a point of tangency of the mounted-point grinding tool.

* * * * *